US007086776B2

(12) United States Patent
Adams

(10) Patent No.: US 7,086,776 B2
(45) Date of Patent: Aug. 8, 2006

(54) PAINT CONTAINER AND COLORANT INJECTOR APPARATUS AND METHOD

(76) Inventor: Roger W. Adams, 477 Carlsfield Way, Hudson, OH (US) 44236

( * ) Notice: Subject to any disclaimer, the term of this patent is extended or adjusted under 35 U.S.C. 154(b) by 281 days.

(21) Appl. No.: 10/441,631

(22) Filed: May 20, 2003

(65) Prior Publication Data

US 2004/0233777 A1 Nov. 25, 2004

(51) Int. Cl.
*B01F 13/00* (2006.01)
*B01F 15/00* (2006.01)
*B65D 25/08* (2006.01)

(52) U.S. Cl. ..... 366/130; 366/336; 366/605; 206/219

(58) Field of Classification Search ..... 366/130, 366/189, 605, 336; 206/219, 221, 222; 222/95; 141/1, 263
See application file for complete search history.

(56) References Cited

U.S. PATENT DOCUMENTS

| | | | | | |
|---|---|---|---|---|---|
| 2,167,437 | A | * | 7/1939 | Hohl et al. | 141/18 |
| 2,528,530 | A | | 11/1950 | Machleder | 220/85 |
| 2,719,628 | A | * | 10/1955 | Ivanoff | 206/221 |
| 2,819,738 | A | * | 1/1958 | Marberg | 366/605 |
| 2,824,010 | A | * | 2/1958 | Pedersen | 426/120 |
| 2,921,718 | A | * | 1/1960 | Meissner | 222/103 |
| 3,043,424 | A | * | 7/1962 | Howard | 366/150.1 |
| 3,088,586 | A | * | 5/1963 | Hardman | 206/221 |
| 3,797,646 | A | * | 3/1974 | Horne | 206/219 |
| 4,050,678 | A | * | 9/1977 | Smith | 366/130 |
| 4,130,198 | A | * | 12/1978 | Aho | 206/221 |
| 4,332,482 | A | * | 6/1982 | Engler | 366/130 |
| 4,798,287 | A | | 1/1989 | Groves et al. | 206/219 |
| 4,926,390 | A | | 5/1990 | Murzsa et al. | 366/249 |
| 4,979,645 | A | | 12/1990 | Groves et al. | 222/105 |
| 5,368,388 | A | | 11/1994 | Fillon et al. | 366/245 |
| 5,388,715 | A | | 2/1995 | Schwidt et al. | 220/354 |
| 5,482,370 | A | | 1/1996 | Dedoes et al. | 366/247 |
| 6,769,800 | B1 | * | 8/2004 | Young | 366/306 |
| 2001/0025865 | A1 | * | 10/2001 | Bravo et al. | 222/465.1 |

FOREIGN PATENT DOCUMENTS

EP 827 2/1979

OTHER PUBLICATIONS

Internet web site URL: http://www.dutchboy.com/twistandpour/index_store.asp. 1 page, Aug. 20, 2003.

* cited by examiner

*Primary Examiner*—Tony G. Soohoo
(74) *Attorney, Agent, or Firm*—Renner, Kenner, Greive, Bobak, Taylor & Weber

(57) ABSTRACT

The present invention provides a paint container and colorant injector apparatus that includes a paint container that retains a base paint therein and provides an opening allowing access to the base paint. An injector assembly couples with the paint container and is operable to locally disperse colorant into the base paint. Such an apparatus is employed in a method for dispersing a colorant throughout a base paint. The method includes providing a base paint in a container, locally dispersing colorant in the base paint, thereafter sealing the container and shaking the container to further disperse the colorant in the base paint throughout the remainder thereof to effect uniform coloring of the base paint.

5 Claims, 5 Drawing Sheets

PAINT CONTAINER AND COLORANT INJECTOR APPARATUS AND METHOD

TECHNICAL FIELD

The present invention generally relates to a paint container and colorant injector apparatus for dispersing a colorant throughout a base paint. The present invention also relates to a method for dispersing a colorant throughout a base paint, and a method for providing base paint and colorant for subsequent mixing to achieve a selected color without the need for involved, specialized mechanical equipment and apparatus.

BACKGROUND ART

Colored or tinted paints are most commonly prepared in the prior art by providing base paint in a typically cylindrical can with a lid, providing a multitude of colorants, on the top of the contents, at a colorant dispenser and mixing apparatus, removing the lid from the can (or punching a hole therein), introducing, via the colorant dispenser apparatus, the precise amount of colorants necessary to achieve the desired resultant paint color, replacing the lid (or plugging the hole) and vigorously shaking the can via the mixing apparatus, to fully disperse the toned colorants and achieve the desired resultant paint color. Virtually any color can be produced through this general method, with an appropriate dispenser and mixing apparatus, but it will be appreciated that both mechanical and operator errors are common in this method, especially for specialized paint colors that require precise metering of multiple colorants.

It is common for paint manufacturers and retailers to install expensive color centers displaying thousands of potential paint colors, in order to enhance the quality and brand recognition of their products. These color racks often complicate and confuse the less discriminating consumers in their color selection process, because they feature a heavily disproportionate number of deep and very intense, less popular and impractical colors. Also, as mentioned, each of these colors must be capable of reproduction in the above-mentioned paint tinting process, requiring that the correct amount of each colorant must be added to the base paint in the store, at the colorant dispenser and mixing apparatus. In this respect, expensive metering apparatus is required to dispense often minimal quantities of a number of colorants. Indeed, up to six different colorants might be needed to achieve some of the selected colors. In the apparatus and method herein, it is appreciated that such a wide range of color offerings is not necessary, and neither is the involved dispenser and mixing apparatus of the prior art.

Currently, providing a paint of a desired color is handled by the paint retailer, as mentioned above. Thus, retailers must invest in substantial space, equipment and trained employee services, and must also account for correcting errors and handling in-store spillage. Currently, there is no known apparatus and method that would allow a do-it-yourself or professional painter to tint a base paint by purchasing a base paint and desired colorants and dispersing those colorants through the base paint through a practical apparatus and method.

Aside from the involved dispenser and mixing apparatus, the prior art does not provide paint container means and additive mixing methods with a more do-it-yourself, on the job, focus. These means and methods suffer from the disadvantage of providing only for top-loading of multiple colorants of differing viscosity, specific gravity and solubility. Top-loading onto the top surface of the base paint within the container makes it difficult to mix the additive with the base paint by shaking the container without the use of a vigorous mixing machine, such as those mentioned above as employed in the retail field. These concepts also suffer from making the process of adding paint to the container either unduly laborious, messy and inaccurate with respect to gauging how much additive has actually been loaded into the container.

In the prior art, it is also necessary to err on the side of buying too much paint for a given job, with the consequence that there is often paint left over once the job is finished. This is inefficient and stems from the fact that the paint is purchased as already-toned paint, having been colored at the point of purchase. If a more universal base paint could be colored on the job as needed, such waste could be avoided or at least minimized.

Thus, there exists a need in the art for a paint container and colorant injector apparatus that may be employed by do-it-yourself and professional painters, without the need for specialized mechanical equipment and apparatus. There also exists a need in the art for a method for dispersing a colorant throughout a base paint that can be practiced on the job by a do-it-yourself or professional painters, without any special skills or elaborate equipment. A need also exists for paint retailers to be able to provide paint and colorant for purchase and mixing by an end user customer, thus eliminating the need for providing paint coloring personnel services and significant capital investment in the involved colorant injector and mixing apparatus of the prior art.

DISCLOSURE OF THE INVENTION

It is an object of the present invention to provide a paint container and colorant injector apparatus and method, wherein a selected colorant may be injected into and dispersed throughout a base paint without the need to employ specialized vigorous mixing apparatus.

It is another object to provide such apparatus and method, wherein the apparatus and method are conducive to being employed and practiced by do-it-yourself painters.

It is yet another objective to have available a single precise factory produced, premixed toned colorant rather than having to dispense factional amounts of individual colorants to achieve a selected color.

It is yet another object to provide colorant-containing injector assemblies that can selectively communicate with a paint container retaining a base paint and can be manipulated to locally disperse the colorant provided therein substantially along one dimension of the container.

It is a further object to provide a multitude of colorant-injector assemblies for use with complementary paint containers retaining base paint, such that a desired tone of colorant may be chosen and subsequently dispersed throughout the base paint in the paint container to impart a desired color to the base paint.

It is yet another object to provide a paint container of a design that can foster the dispersion of a colorant throughout a base paint retained within the container upon manual manipulation of the paint container itself.

It is yet another object to provide a paint container and colorant injector apparatus with a dispersion accelerator, which can hasten and improve the dispersion process at the point of initial colorant injection.

At least one of the foregoing objects, as well as other objects that will become apparent from the description that follows, are achieved by the apparatus and methods herein described and claimed.

In general, the present invention provides a paint container and colorant injector apparatus comprising a paint container and colorant injector apparatus comprising, a container retaining a base paint therein and providing an opening allowing access to the base paint, and an injector assembly for locally dispersing colorant into the base paint in the container substantially uniformly along one dimension of the container.

This invention also provides an injector assembly for injecting colorant into a base paint retained in a paint container having an opening for allowing access to the base paint comprising a flexible tube having a first closed end and an opposed second end and a grasping portion extending from said first closed end and a slotted cap that is fashioned to close the opening of the paint container, wherein said flexible tube maintains a colorant between said first closed end and said opposed second end thereof, said grasping portion extends above a slot in said slotted cap.

The present invention also provides a method for dispersing a colorant throughout a base paint comprising, the steps of providing base paint in a container, locally dispersing colorant in the base paint substantially along one dimension of the container, sealing the container and shaking the container to further disperse the colorant in the base paint throughout the remainder thereof to effect uniform coloring of the base paint.

The present invention also discloses a method for providing a base paint and a selected colorant for subsequent manual mixing comprising the steps of providing for the purchase of a base paint in a container, providing for the purchase of any of a plurality of colorants individually retained in respective injector assemblies that are each adapted to be selectively coupled with the container for injection of the colorant into the base paint in the container, such that a desired mix of base paint and colorant can be effected by an end user by purchasing the base paint in the container and purchasing at least one injector assembly that retains a desired colorant and, thereafter, selectively coupling the same and manually manipulating the same to mix the colorant and base paint.

BEST MODE FOR CARRYING OUT THE INVENTION

Figure 1:
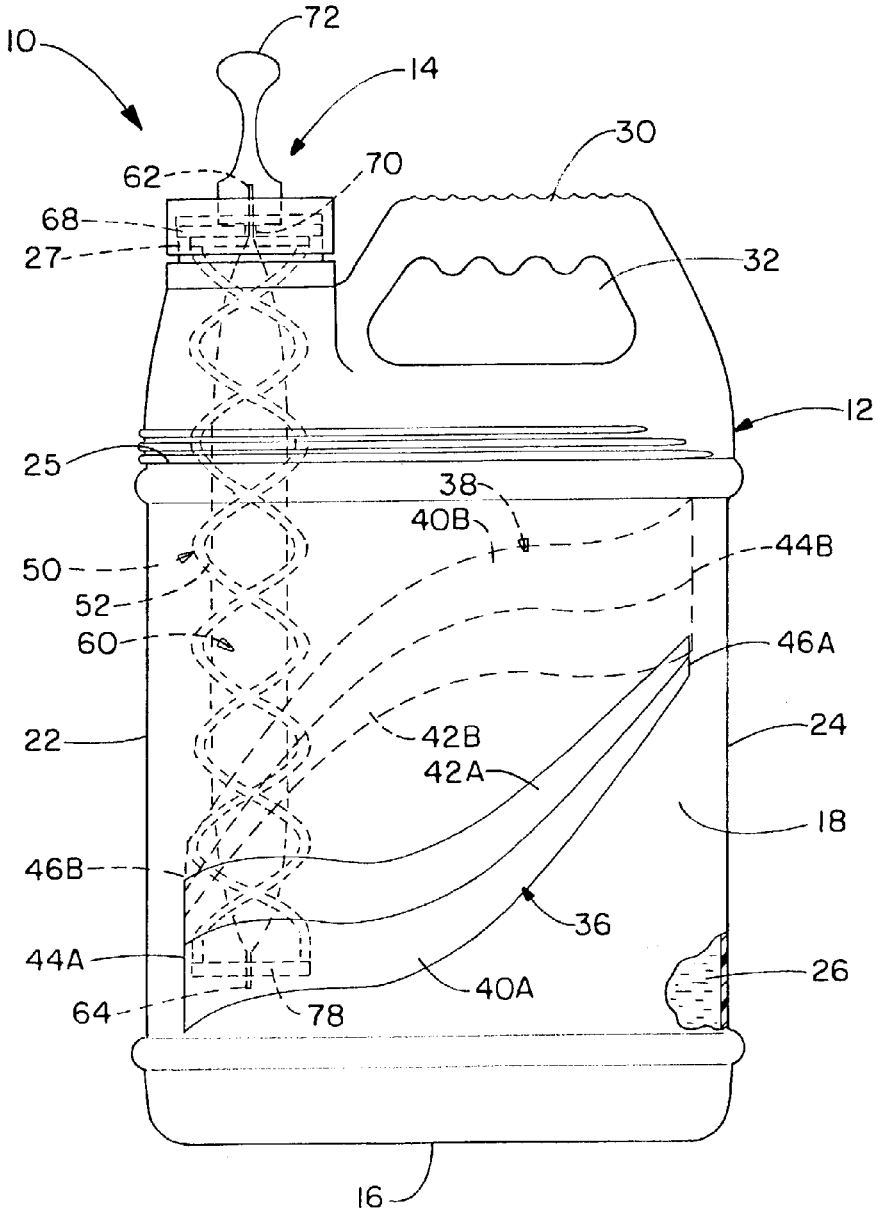
FIG. 1 is a side elevational view of an exemplary paint container and colorant injector apparatus according to the concepts of the present invention.

With reference to FIG. 1, it can be seen that an exemplary paint container and colorant injector apparatus according to the present invention is generally indicated by the numeral 10. Apparatus 10 includes paint container 12 and at least one separate selectable injector assembly 14. Paint container 12 and injector assembly 14 are separately disclosed hereinbelow, and thereafter, their interaction in providing a paint container and colorant injector apparatus 10 and an associated method for dispersing a colorant throughout a base paint are disclosed.

Figure 3:
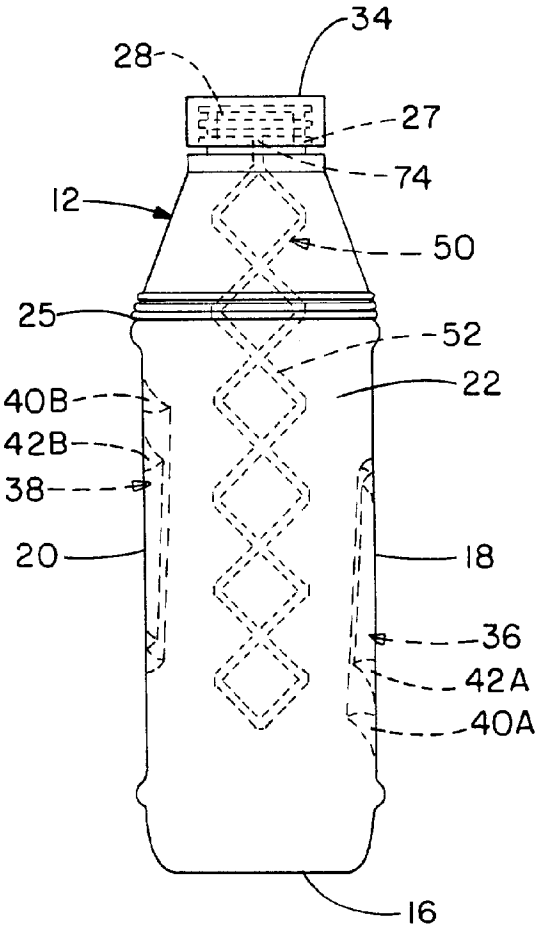
FIG. 3 is a front elevational view of the paint container of FIG. 2.
Figure 2:
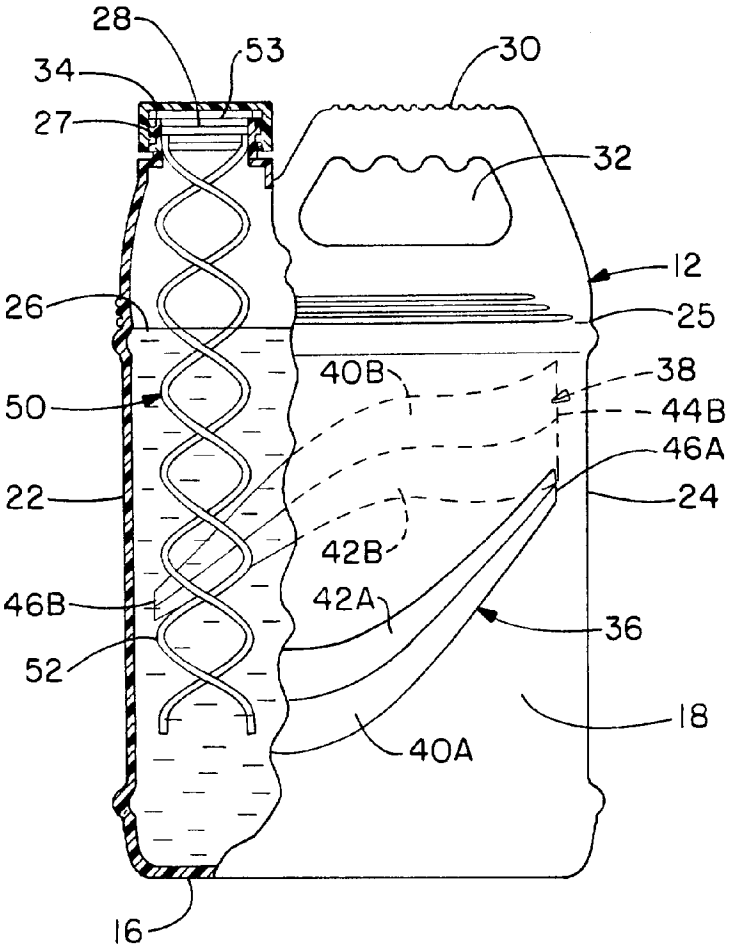
FIG. 2 is a side elevational view similar to FIG. 1 but with a portion of the container side wall broken away to show an optional dispersion accelerator tube as it may be mounted in the paint container.

Paint container 12 may take any number of shapes, although the shape depicted in FIGS. 1–3 is advantageous for a number of reasons. Notably, the shape shown is easy to ship, shelve and manually manipulate. Paint container 12 is generally rectangular in both a vertical and horizontal cross-section and includes base 16 from which extends opposed sidewalls 18, 20 and opposed front and rear walls 22, 24, respectively. These opposed walls 18, 20 and 22, 24 extend to fill line 25 to provide a volume for retaining a base paint 26. Above fill line 25, side walls 18, 20, front wall 22 and rear wall 24 extend somewhat angularly inwardly to form a pour spout 27, having an opening 28, and also form a handle 30. Handle 30 is substantially defined by a grip opening 32, and in preferred embodiments, is hollow.

With particular reference to FIGS. 2 and 3, it can be seen that paint container 12 is provided as a separate and distinct component of paint container and colorant injector apparatus 10 and, as such, is provided with a cap 34, which couples with pour spout 27 to effect a fluid-tight seal of opening 28. Although other couplings might be employed, cap 34 is preferably threaded (as depicted) to couple and uncouple with a complementary threaded pour spout 27 when relatively rotationally engaged. The complete paint container and colorant injector apparatus 10, as in FIG. 1, is provided only after removing cap 34 and thereafter coupling injector assembly 14 to paint container 12 at opening 28, as will be described more fully below. Thus, base paint 26 may be supplied in paint container 12, at a point of sale, for individual purchasing, and injector assemblies 14 can likewise be sold individually.

Although other features are depicted in FIGS. 1–3, and will be described below, paint container 12 may generally be provided with the elements thus far disclosed. It should again be appreciated, as mentioned above, that paint container 12 may take various forms, with the present form being the preferred version.

Paint container 12 may optionally include mixing baffles 36, 38 which, in the preferred embodiment of FIGS. 1–3 are shown as being formed in side walls 18, 20, respectively. Although a particular baffle configuration is shown herein as being preferred, this invention may benefit from baffles of varying configurations. As can be clearly seen in the Figs., mixing baffles 36, 38 are symmetrically opposed to one another, with respect to their positioning in paint container 12. More particularly, it should be appreciated that mixing baffle 38 is substantially identical to mixing baffle 36 but is vertically inverted and placed on an opposed side wall such that, as will be described more fully below, the effect that mixing baffle 38 has upon the contents of paint container 12 complements the effect that mixing baffle 36 has upon the contents and vice versa.

Mixing baffles 36, 38 each include a deep contour 40A, 40B, respectively, and a shallow contour 42A, 42B, respectively. Like numerals have been employed for each like contour, with the further designation of "A" and "B" being employed to indicate that these contours complement one another as indicated above. Deep contour 40A and shallow contour 42A of mixing baffle 36 each extend, in a general arcuate swirling direction, from a widely spaced end 44A upwardly to a narrowly spaced end 46A. Likewise and in a complementary fashion, deep contour 40B and shallow contour 42B of mixing baffle 38 extend in a general arcuate swirling direction from wide end 44B downwardly to narrow end 46B. These mixing baffles 36, 38 may take other similar forms providing the ability to perform the mixing function that will be described more fully below. Thus, while mixing baffles 36, 38 may be optionally and preferably employed in providing a paint container 12 according to this invention, it should be appreciated that a multitude of other baffle configurations may be employed, including adding or subtracting baffles. Additionally, as shown in the Figs., mixing baffles 36, 38 are preferably directly molded into side walls 18, 20, with the contours being visible on the exterior of container 12.

A dispersion accelerator 50 may be provided, either as part of injector assembly 14 or as part of paint container 12, although it is preferred that a dispersion accelerator 50 be provided as part of injector assembly 14. In FIGS. 1 and 4–6, dispersion accelerator 50 is shown as part of injector assembly 14, and dispersion accelerator 50A is shown as part of injector assembly 14A. In FIGS. 2 and 3, dispersion accelerator 50 is shown as part of paint container 12. FIG. 7 depicts the structure of a particularly preferred dispersion accelerator designated by the numeral 500, and it will be appreciated that the similar yet varying structures of the dispersion accelerators shown throughout FIGS. 1–7 are all suitable and non-limiting structures. In FIG. 7, like parts receive like numerals, but increased by 500. As part of paint container 12 (FIGS. 2 and 3), dispersion accelerator 50 includes a latticed tube 52 that extends downwardly through opening 28 into pour spout 27 and the internal volume of paint container 12, past fill line 25, and preferably to a position generally proximate to but offset from base 16. Latticed tube 52 may take different forms, as shown in FIGS. 2–5. Indeed, even a single spiral configuration, such as that shown in FIG. 4, may be employed. Tube 52 may be integral with or separate from paint container 12. If integral therewith, tube 52 would most likely be molded to opening 28, and, if separate, would most likely include a cap 53 having a flange 54 and notch 56 configured to allow dispersion accelerator 50 to be snap fit into opening 28, as shown, with the flange 54 resting along the lip of opening 28 and notch 56 extending into a recess below opening 28.

Although dispersion accelerators 50, 50A or 500 may optionally be integral with paint container 12, in the preferred embodiment herein, dispersion accelerators 50, 50A or 500 are separate therefrom. More particularly, in preferred embodiments, the dispersion accelerators are provided as part of an injector assembly 14, and as such, are separate from the paint container, and configured to snap fit into the opening (such as opening 28) thereof.

Figure 4:
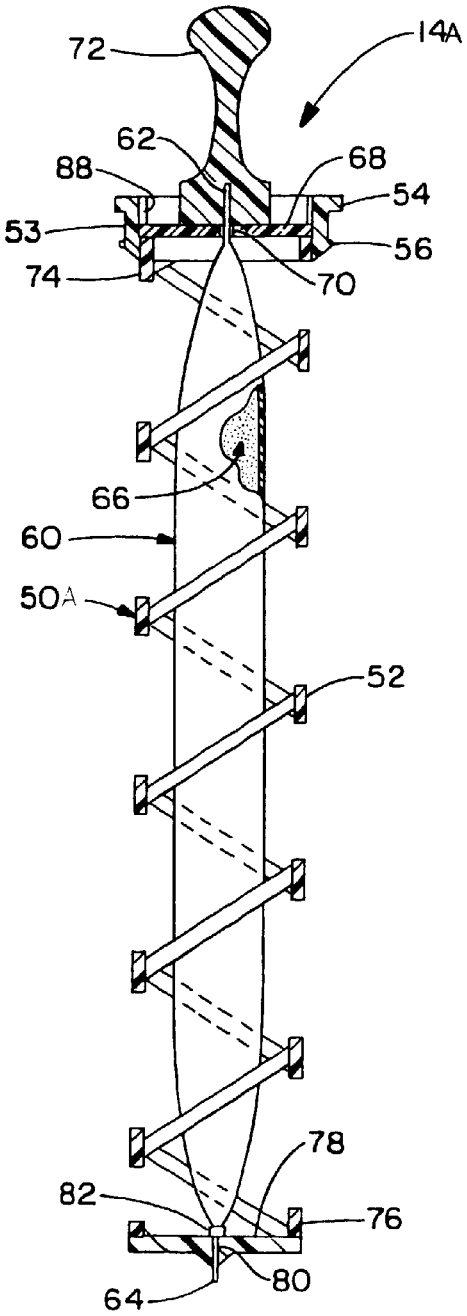
FIG. 4 is a side elevational view of the injector assembly, as shown in FIG. 1, removed from its position within the paint container and with its slotted cap shown in cross-section.
Figure 5:
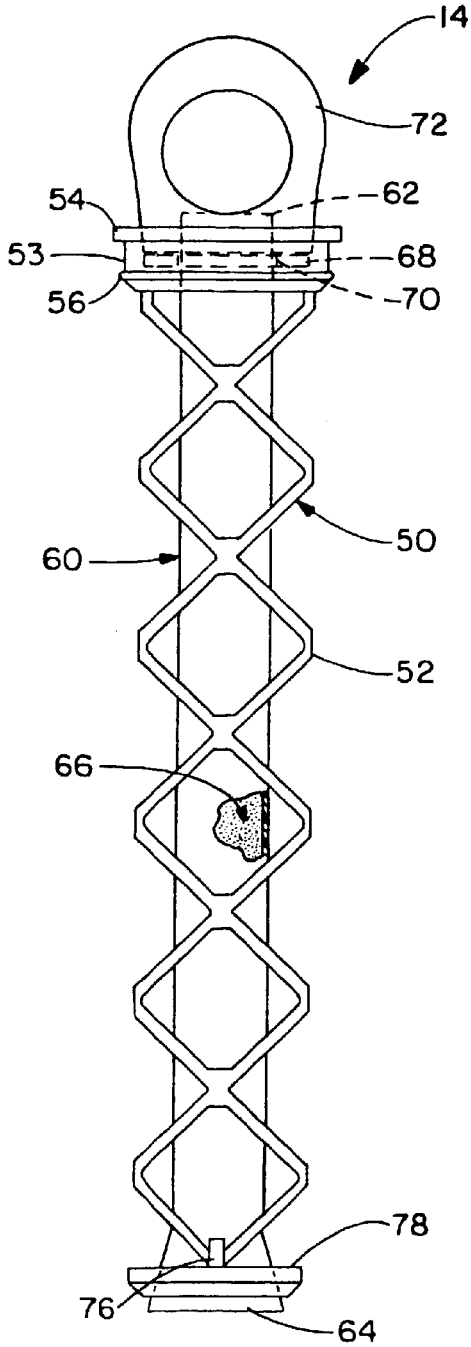
FIG. 5 is a front elevational view of the injector assembly of FIG. 4.

Preferred injector assemblies 14, 14A which incorporate different structures of dispersion accelerators 50, 50A into their designs are represented in FIGS. 4 and 5. FIG. 4 depicts the single spiral configuration, and is in other respects similar to the double-spiral type lattice configuration of FIG. 5. Injector assemblies 14, 14A each include a flexible tube 60, which is sealed at first end 62 and at opposed second end 64. A colorant, generally indicated by the numeral 66, is maintained between first end 62 and second end 64. Flexible tube 60 may be constructed from any suitable flexible material that will allow injector assembly 14 to function as disclosed below. Typically, flexible tube 60 will be constructed from a plastic material, such that first and second ends 62, 64 may be pressed and heat sealed, as is generally represented in FIGS. 4 and 5.

First end 62, where flexible tube 60 is pressed and heat sealed, extends through stripping plate 68, particularly through slot 70 therein. A pull tab 72 is attached to and extends from first end 62, above slot 70 in stripping plate 68. Stripping plate 68 is removably received in cap 53, which allows the entire injector assembly 14 to be snap fit into opening 28 of container 12. As mentioned above, with respect to providing dispersion accelerator 50 as a separate element from paint container 12, dispersion accelerator 50 depends from cap 53, when it is provided, as in this preferred embodiment, as part of injector assembly 14. Particularly, first end 74 of dispersion accelerator 50 is connected to cap 53 (or is integral therewith) and second end 76 is associated with a collar insert 78, which functions as a closure member for second end 64 of flexible tube 60. Collar insert 78 provides a tight slot 80 through which extends second end 64 of flexible tube 60, with the fit being such that second end 64 is pinched with sufficient force to hold second end 64 in slot 80 absent any counter-force exerted on pull tab 72 to pull second end 64 out of slot 80.

Figure 6:
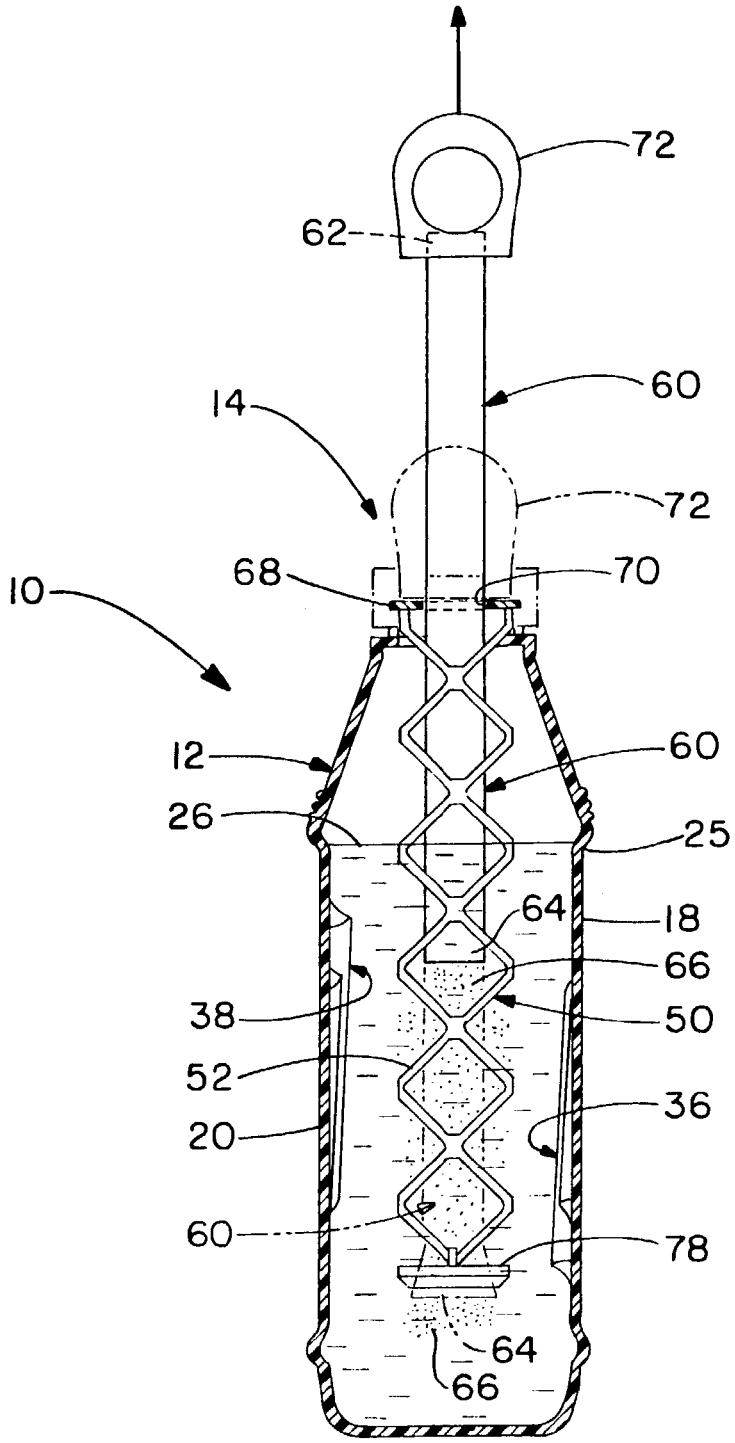
FIG. 6 generally represents the method for manipulating the paint container and colorant injector apparatus of the invention in order to locally disperse colorant throughout a base paint, and is a front elevational view of the paint container with the container front wall removed to show the dispersion accelerator and the colorant injector tube extending therein and in a partially retracted position.
Figure 7:
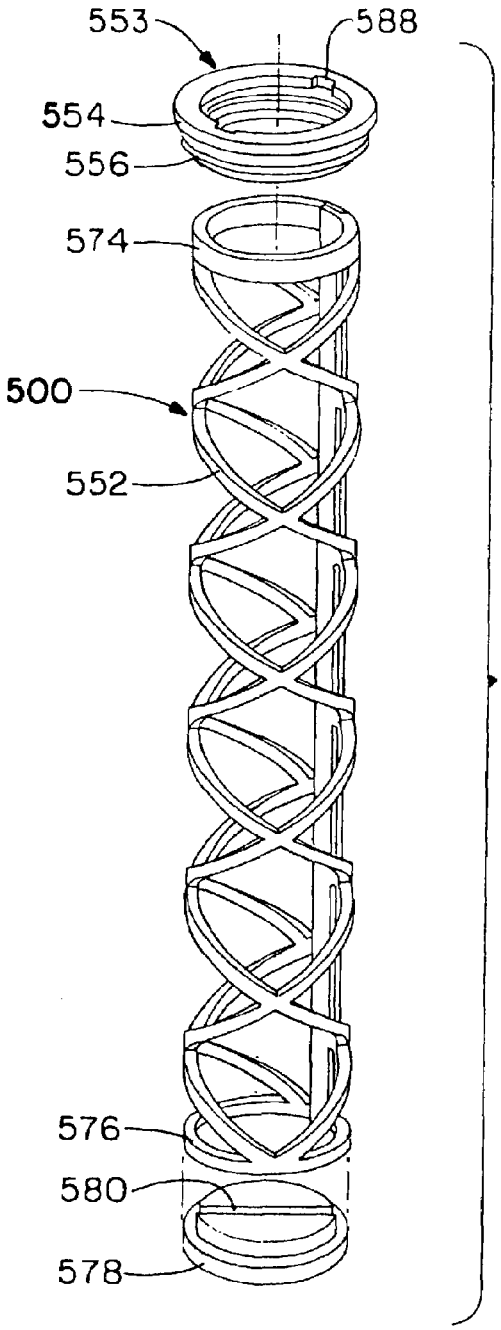
FIG. 7 is an assembly diagram of a preferred dispersion accelerator.

Thus, paint container 12 and injector assembly 14, while being separate and distinct components, are fit together, as at opening 28 and cap 53 in FIGS. 1 and 6, to provide combined paint container and colorant injector apparatus 10, after first removing cap 34 of paint container 12 to expose opening 28, and inserting injector assembly 14 therein by fitting cap 53, flange 54 and notch 56 at opening 28, such that flexible tube 60 extends downwardly into paint container 12. Having described paint container 12 and injector assembly 14 and their interaction in providing paint container and colorant injector apparatus 10, the method for dispersing a colorant throughout a base paint according to the invention is generally discussed with reference to FIGS. 1 and 6.

Paint container 12, which contains a base paint 26, is opened by removing cap 34 from its coupling with pour spout 27, to expose opening 28. An injector assembly 14, containing the desired colorant 66, is obtained and at least a portion of flexible tube 60 is opened. Particularly, according to the preferred embodiment of this invention, flexible tube 60 is opened at or proximate second end 64 by severing flexible tube 60 below slot 80. This provides flexible tube 60 with an open second end 64. Opening 28 of paint container 12 is then closed with the insertion of injector assembly 14 and the fitting of cap 53 with flexible tube 60 (now having an open end 64) extending downwardly into the interior volume of paint container 12. Thereafter, pull tab 72 is manually engaged and flexible tube 60 is extracted through slot 70 of stripping plate 68, thereby forcing colorant 66 out of open second end 64 and squeezing colorant 66 out of flexible tube 60, from the bottom of paint container 12 to the top. This injection of colorant 66 into a base paint 26 in paint container 12 is generally represented in FIG. 6, wherein flexible tube 60 has been pulled approximately halfway through stripping plate 68 (original positioning being shown in phantom). It will be appreciated from FIG. 4, and the depiction and description of tube 60 and slot 70, that the portion of tube 60 pulled above stripping plate 68 is substantially flattened by the effect of slot 70. To prevent the entirety of flexible tube 60 from being pulled from slot 70, thereby creating a potential for the dripping and splattering of small amounts of base paint and colorant that might cling to or remain within flexible tube 60, flexible tube 60 is preferably provided with enlarged portion or stop 82, proximate second end 64 but above collar insert 78. Stop 82 is sized larger than slot 70, such that tube 60 cannot be pulled completely out. In the preferred embodiment, stop 82 is formed by crimping the flexible material of the tube 60 at the appropriate position.

It can be seen that, in the manner just described, colorant is locally dispersed substantially uniformly along one dimension of the interior of paint container 12. In the preferred embodiment herein disclosed, colorant 66 is dispersed substantially vertically along the height of paint container 12, although adaptations to the present invention could provide for dispersion along other dimensions. Also, it should be appreciated that by "locally dispersed" it is meant that colorant 66 is dispersed only through a portion of the base paint in paint container 12, and is not yet fully dispersed to provide the desired end result paint color. It should also be appreciated that, upon injection as described, colorant 66 does become somewhat dispersed in other dimensions.

If optional dispersion accelerator 50 is present, whether as an integral or separable part of paint container 12 or as a separate or integral part of injector assembly 14, dispersion can be facilitated. Particularly as flexible tube 60 is pulled through slot 70, paint rushes into latticed tube 52, as paint moves to fill the space once occupied by flexible tube 60, and turbulence develops therein to facilitate the dispersion of colorant 66 within and around latticed tube 52. It should also be appreciated that, during a subsequent shaking step of the dispersion step, which is described immediately below, the semi-blended base paint and colorant (i.e., base paint with locally dispersed colorant) is forced out of dispersion accelerator 50, and the substantially stationary position of dispersion accelerator 50 operates as a stirring paddle with fins 84 increasing the mixing effect.

Figure 8:
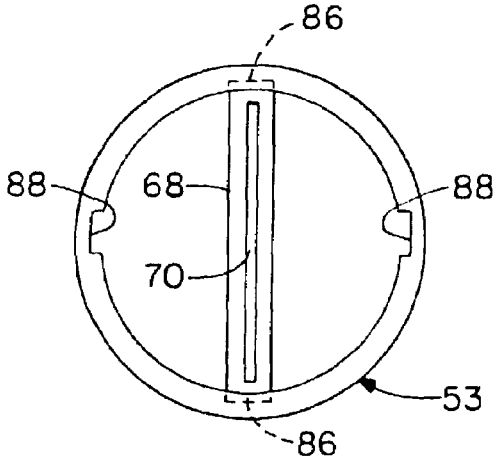
FIG. 8 is a top plan view of the interaction of cap end stripping plate elements associated with a dispersion accelerator.

In order to fully remove flexible tube 60 from connection with the dispersion accelerator (whether accelerator 50, 50A or 500), cap 53 (or 553) is configured to removably receive stripping plate 68 and the pull tab 72 and flexible tube 60 associated therewith. In FIG. 8, a top view of cap 53 and its interaction with stripping plate 68 is depicted with all other elements of an injector assembly 14 being removed, so that attention can be focused on the function relationship between cap 53 and stripping plate 68. It will be appreciated that cap 553 of the dispersion accelerator 500 of FIG. 7 would function in the same manner with an associated stripping plate, pull tab, and flexible tube containing colorant. After locally dispersing colorant 66 into the base paint 26 in container 12, tube 60 and stripping plate 68 are removed from dispersion accelerator 50 by turning stripping plate 68 to align tabs 86 with notches 88 of cap 53, and, thereafter, pulling further on tab 72, cap 34 may then be mated with threaded pour spout 27 to close the container. Cap 34 creates a fluid-tight seal at opening 28, such that paint container 12 can be manually shaken to completely disperse colorant throughout the base paint 26 and achieve the desired end result color. Notably, the preferred shape of paint container 12, having a substantial hollow volume above fill line 25, helps to ensure that, during manual shaking of paint container 12, colorant 66 and base paint 26 are vigorously agitated to achieve a complete dispersion of colorant 66 in a minimal amount of time.

Mixing baffles 36, 38, disclosed above as being optional, yet preferred, further facilitate complete dispersion of colorant 66. More particularly, when paint container 12 is laid horizontal, on one of its sides 18, 20, and is moved back and forth in an oscillating motion from base 16 to handle 30 and back again (paralleling the direction of local dispersement of the colorant), mixing baffle 36 urges the base paint 26 and colorant 66 toward the top of paint container 12, and mixing baffle 38 urges the base paint 26 and colorant 66 toward base 16. This opposing movement circulates the paint and colorant throughout the container rather than merely causing a turbulence, and greatly increases the efficiency of the shaking step in completely dispersing colorant 66 throughout base paint 26. Also, the deep contours 40A, 40B and shallow contours 42A, 42B of mixing baffles 36, 38 swirl from wide ends 44A, 44B to narrow ends 46A, 46B, which focuses the base paint 26 and colorant 66 that are being blended toward the corners of the container, where efficient mixing is oftentimes more difficult to achieve. As already mentioned, the presence of dispersion accelerator 50 will also facilitate dispersion.

The invention herein thus advances the art in many particulars. It provides a simple method for dispersing colorant into a base paint and provides a useful paint container for practicing the method, especially when optional components are incorporated into the design of the paint container. The apparatus and method are particularly useful for both do-it-yourself and smaller professional painters, allowing them to purchase paint and colorants off the shelf without having to rely on and wait for specially trained sales clerks to mix a selected color. The provision of this apparatus and method will also dramatically reduce a paint retailer's investment in space and tinting and mixing equipment, and will reduce employee service expenses, error correction expenses, and in-store messes that are typically resultant from malfunction of the involved tinting and mixing equipment generally employed in the art. Indeed, the present invention contemplates and provides a new method for providing base paint and colorant to an end user for subsequent manual mixing without involved mechanical equipment and apparatus.

Notably, it is herein appreciated that 70 percent of the market for interior do-it-yourself paints exists in off-white and light pastel colors. Thus, although the present invention allows that virtually any color paint might be achieved by means of providing the right mix of colorants in an injector assembly and employing the same according to this invention, it is another aspect of this invention to focus upon this large portion of the market. A method for providing base paint and colorant for subsequent manual mixing, and, particularly, for providing base paint and colorants that can be manually mixed to created colored paints within this large portion of the market is therefore disclosed. In this method, base paint is provided for purchase in paint containers according to this invention, and a plurality of colorants are also provided for purchase as individually retained in respective injector assemblies according to this invention. Approximately 50 different colors, each in a "full" strength and a "half" strength version, would be provided, rendering 100 individual colors. These different colors would be chosen based upon the observation disclosed above, namely, that about 70 to about 80 percent of the do-it-yourself paint market resides in off-white and muted pastel colors, such that the approximately 50 different colors would be chosen in order to be capable of providing these most popular colors. The colorant's strength could be reduced by adding an extender to the colorant or by reducing the colorant quantity (e.g., by using a smaller diameter flexible tube in the injector assemblies). While it is generally contemplated and preferred that only one injector assembly would have to be employed with a given quantity of base paint in a paint container, the present invention also allows for using multiple injector assemblies with a single quantity of base paint in a paint container, in order to achieve additional desired paint colors. Also, offering both a white base paint and a mid-tone base paint would double the potential number of colors that could be realized.

The present disclosure has focused upon providing an apparatus and method for dispersing a "colorant" through a "base paint". It should, however, be appreciated by those of skill in the art that paints, varnishes, wood stains, plural component products and even non-paint products, for purposes of this invention, are substantial equivalents to "base paint," and other additives, such as fungicides, foaming agents, rheology modifiers, thickeners, catalysts, particulate solid additives and the like, are substantial equivalents to "colorants". Thus, the apparatus and methods herein may be employed to cover the dispersion of any such additive in any such base composition.

In the particular base paint/colorant dispersion apparatus and method of the best mode, the base paint provided will typically be selected from flat, satin and semi-gloss paints that are of lighter color, and designed for interior use, although exterior products, in lighter colors will also work. The colorants, as generally known, are provided as pigment fillers suspended throughout a carrier matrix, wherein the strength of the colorant is based upon the concentration of the filler as well as the ratio of a clear extender vehicle within that matrix.

Thus, it should be evident that the paint container and colorant injector apparatus and methods disclosed herein constitutes an advantageous contribution to the art. As will be apparent to persons skilled in the art, modifications can be made to the preferred embodiments disclosed herein without departing from the spirit of the invention, the scope of the invention herein being limited solely by the scope of the attached claims.

What is claimed is:

1. A paint container and colorant injector apparatus comprising;

a container retaining a base paint therein and providing an opening allowing access to the base paint; and an injector assembly for locally dispersing colorant into the base paint in the container substantially uniformly along one dimension of the container, said injector assembly including:

a flexible tube having a first closed end and an opposed second end and a grasping portion extending from the first closed end, a stripping plate having a slot therein and adapted to be selectively positioned in said opening of said container, a colorant retained between said first closed end and said opposed second end of said flexible tube, wherein, when said stripping plate is positioned in said opening of said container, said grasping portion of said injector assembly extends above said slot in said stripping plate, and said flexible tube of said injector assembly extends downwardly to said opposed second end, into said container and base paint, and said flexible tube is selectively movable through said slot in said stripping plate by manipulation of said grasping portion, pulling said opposed second end of said flexible tube upwardly toward said slot; and a stop on said opposed second end of said flexible tube, said stop sized larger than said slot in at least one dimension to prevent said opposed second end from being pulled through said slot.

2. A paint container and colorant injector apparatus comprising:

a container retaining a base paint therein and providing an opening allowing access to the base paint;

an injector assembly for locally dispersing colorant into the base paint in the container substantially uniformly along one dimension of the container, said injector assembly including:

a flexible tube having a first closed end and an opposed second end and a grasping portion extending from the first closed end, a stripping plate having a slot therein and adapted to be selectively positioned in said opening of said container, a colorant retained between said first closed end and said opposed second end of said flexible tube, wherein, when said stripping plate is positioned in said opening of said container, said grasping portion of said injector assembly extends above said slot in said stripping plate, and said flexible tube of said injector assembly extends downwardly to said opposed second end, into said container and base paint, wherein said container and said injector assembly are separate and distinct elements that are selectively coupled by inserting said injector assembly into said opening of said container, and said container includes a sealing cap that seals said opening in said container before said container and said injector assembly are selectively coupled, such that said sealing cap is removed before said injector assembly is inserted into said opening.

3. A paint container and colorant injector apparatus of comprising:

a container retaining a base paint therein between a plurality of sidewalls thereof, and providing an opening allowing access to the base paint;

a dispersion accelerator including a latticed tube extending downwardly from said opening into said container; and an injector assembly for locally dispersing colorant into the base paint in the container substantially uniformly along one dimension of the container, said injector assembly including:

a flexible tube having a first closed end and an opposed second end and a grasping portion extending from the first closed end, a stripping plate having a slot therein and adapted to be selectively positioned in said opening of said container, a colorant retained between said first closed end and said opposed second end of said flexible tube, wherein, when said stripping plate is positioned in said opening of said container, said grasping portion of said injector assembly extends above said slot in said stripping plate, and said flexible tube of said injector assembly extends downwardly to said opposed second end, into said container and base paint, with said latticed tube of said dispersion accelerator surrounding and in close proximity to said flexible tube and distanced from at least one of said plurality of sidewalls of said container.

4. The paint container and colorant injector apparatus of claim 1, wherein said container includes a hollow handle portion, and the base paint therein is filled to a fill line that is below said hollow handle portion.

5. The paint container and colorant injector apparatus of claim 3, wherein said container includes opposed side walls and opposed front and rear walls, and symmetrically opposed contours positioned in at least one of said opposed side walls and said opposed front and rear walls.

* * * * *